US012152590B2

(12) United States Patent
Chalearmwattananon

(10) Patent No.: US 12,152,590 B2
(45) Date of Patent: Nov. 26, 2024

(54) SCROLL COMPRESSOR

(71) Applicant: SIAM COMPRESSOR INDUSTRY CO., LTD., Chonburi (TH)

(72) Inventor: Nutthaporn Chalearmwattananon, Chonburi (TH)

(73) Assignee: SIAM COMPRESSOR INDUSTRY CO., LTD., Chonburi (TH)

( * ) Notice: Subject to any disclaimer, the term of this patent is extended or adjusted under 35 U.S.C. 154(b) by 0 days.

(21) Appl. No.: 18/681,913

(22) PCT Filed: Mar. 28, 2022

(86) PCT No.: PCT/IB2022/052792
§ 371 (c)(1),
(2) Date: Feb. 7, 2024

(87) PCT Pub. No.: WO2023/187438
PCT Pub. Date: Oct. 5, 2023

(65) Prior Publication Data

US 2024/0337263 A1 Oct. 10, 2024

(51) Int. Cl.
*F04C 18/02* (2006.01)
*F04C 29/06* (2006.01)
*F04C 29/12* (2006.01)

(52) U.S. Cl.
CPC ..... *F04C 29/12* (2013.01); *F04C 18/0215* (2013.01); *F04C 29/065* (2013.01); *F04C 29/068* (2013.01); *F04C 2240/30* (2013.01)

(58) Field of Classification Search
CPC ..... F04C 18/0215; F04C 18/0253; F04C 29/065; F04C 29/068; F04C 29/12
See application file for complete search history.

(56) References Cited

U.S. PATENT DOCUMENTS

2012/0148433 A1* 6/2012 Liang ..... F04C 18/0215 418/55.1
2018/0328364 A1* 11/2018 Kim ..... B01D 45/14

FOREIGN PATENT DOCUMENTS

JP 2018-053746 A 4/2018
WO 2007/027168 A1 3/2007

OTHER PUBLICATIONS

International Search Report and Written Opinion of the International Searching Authority mailed Nov. 21, 2022 in corresponding International Patent Application No. PCT/IB2022/052792.

* cited by examiner

*Primary Examiner* — Deming Wan
(74) *Attorney, Agent, or Firm* — Posz Law Group, PLC

(57) ABSTRACT

The present invention discloses a scroll compressor comprising: a first cover fixed on a fixed scroll; and a second cover fixed on the first cover. The first cover includes a first top plate and a first peripheral wall, which forms a first space inside. The second cover includes a second top plate and a second peripheral wall, which forms a second space inside. The first space connects to a discharge port that penetrates the fixed scroll. Multiple through holes are formed to penetrate the first top plate so that the through holes with different diameters connect the first space and the second space.

2 Claims, 4 Drawing Sheets

SCROLL COMPRESSOR

CROSS-REFERENCE TO RELATED APPLICATION

This application is a U.S. national stage application of PCT/IB2022/052792 filed on Mar. 28, 2022, the contents of which are incorporated herein by reference.

FIELD OF INVENTION

The present invention relates to a scroll compressor.

BACKGROUND OF THE INVENTION

It is known that a scroll compressor includes a first cover fixed on a fixed scroll with a first space inside and a second cover fixed on the first cover with a second space so that a through hole is formed to penetrate the first cover, as disclosed Japanese Unexamined Patent Application Publication No. 2018-53746A hereinafter called PTL1.

In PTL1, the compressed refrigerant periodically flows into the first space from the compression mechanism, which causes a discharge pulsation which is a pressure fluctuation in the first space. The discharge pulsation causes vibration in the compressor and can cause noise generated by the compressor. Moreover, noise and vibration may occur due to mechanical moving parts in the compressor.

Furthermore, in case that the rotation speed of the compressor can be changed, there is a possibility that noise and vibration does not reduced.

Therefore, the development of the scroll compressor that can effectively reduce noise and vibration caused by discharge pulsation and the mechanical moving parts with a simple configuration, is required.

CITATION LIST

Patent Literature

PTL 1: Japanese Unexamined Patent Application Publication No. 2018-53746A

SUMMARY OF THE INVENTION

It is an objective of the present inventions to provide a scroll compressor that can effectively reduce noise and vibration caused by discharge pulsation and mechanical moving parts with a simple configuration.

In order to achieve the above objective, an embodiment of the present invention provides a scroll compressor comprising: a first cover fixed on a fixed scroll; and a second cover fixed on the first cover, wherein the first cover includes a first top plate and a first peripheral wall extending downward from the entire circumference of an edge of the first top plate, which is configured to form a first space inside, wherein the second cover includes a second top plate and a second peripheral wall extending downward from the entire circumference of an edge of the second top plate so that an entire lower end of the second peripheral wall connects to the first top plate, which is configured to form a second space inside, wherein the first space connects to a discharge port that penetrates the fixed scroll and allows compressed refrigerant to flow, and wherein multiple through holes are formed to penetrate the first top plate of the first cover so that the through holes with different diameters connect the first space and the second space.

According to the embodiment of the present invention, since the configuration surrounded by the first cover and the second cover includes the second space that communicates only with the first space and multiple through holes that communicate between the first space and the second space, the configuration surrounded by the first cover and the second cover forms a Helmholtz type resonance chamber communicating with the first space.

In the configuration surrounded by the first cover and the second cover, which is the Helmholtz type resonance chamber, the gas inside the second space acts as a spring, and the gas inside the through holes vibrates rigidly to resonate with sounds of specific frequencies. By generating frictional energy between the gas vibrating inside the through holes and inner walls of the through holes, the sound energy caused by discharge pulsation and the vibration energy caused by mechanical moving parts are reduced.

As such, it is possible to reduce noise and vibration caused by discharge pulsation and the mechanical moving parts.

Moreover, since multiple through holes are formed to penetrate the first top plate of the first cover so that the through holes with different diameters connect the first space and the second space, the Helmholtz type resonance chamber that resonates at different specific frequencies with a simple configuration can be formed.

Therefore, the scroll compressor can effectively reduce noise and vibration caused by discharge pulsation and mechanical moving parts with a simple configuration.

BRIEF DESCRIPTION OF DRAWINGS

The principle of the present invention and its advantages will become apparent in the following description taking in consideration with the accompanying drawings in which.

DETAILED DESCRIPTION OF EMBODIMENTS OF THE INVENTION

Hereinafter, an embodiment of the present invention will be described in detail with reference to the drawings.

Figure 1:
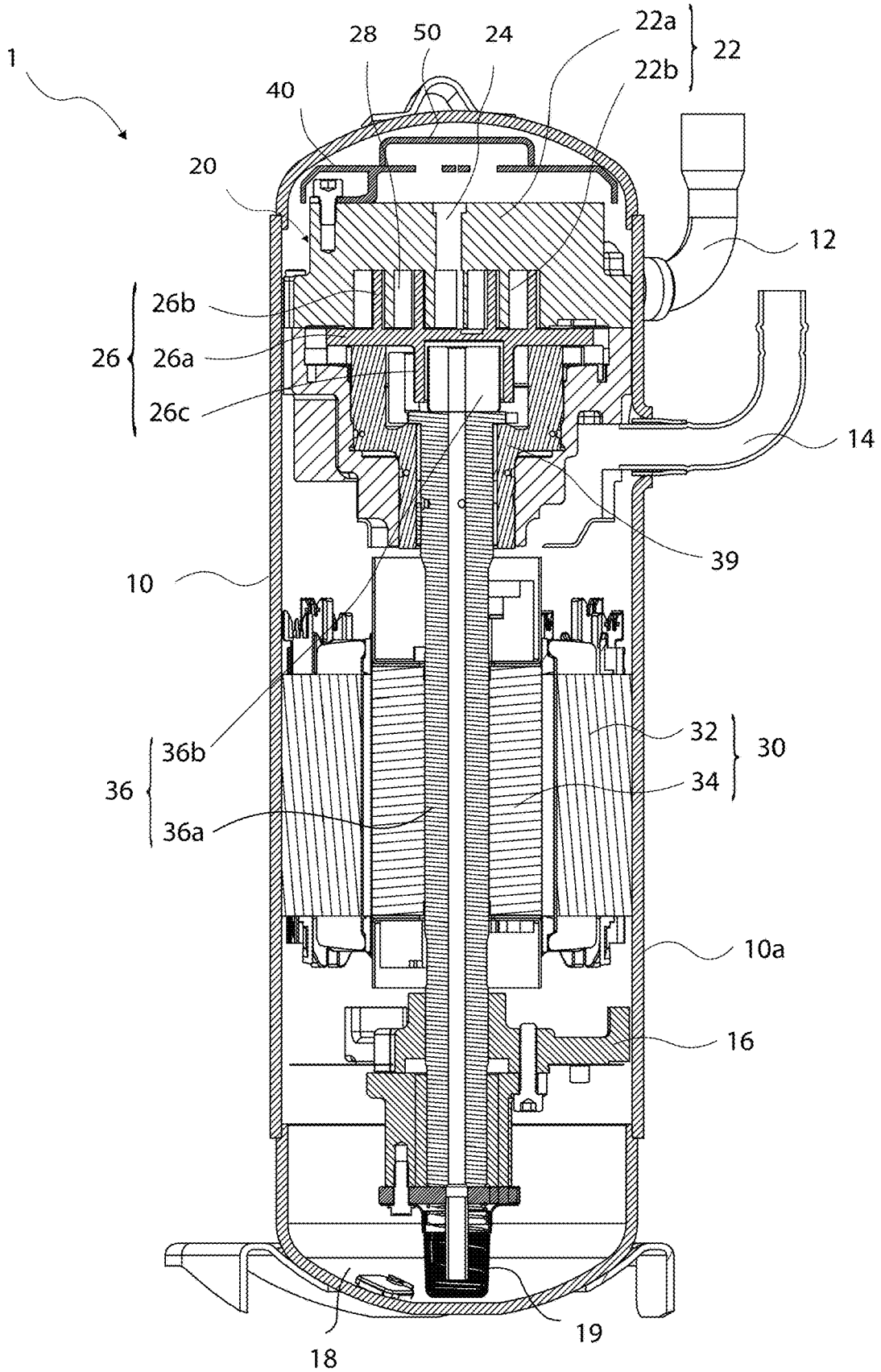
FIG. 1 is an explanation view illustrating a schematic configuration of a scroll compressor 1 including a first cover 40 and a second cover 50 according to an embodiment of the present invention.

FIG. 1 is an explanation view illustrating a schematic configuration of a scroll compressor 1 according to the embodiment. The scroll compressor 1 is a fluid machine configured to compress and discharge a fluid (i.e., gas refrigerant), and can be a component of a refrigeration cycle apparatus. The scroll compressor 1 according to the embodiment is a vertically-mounted shell compressor.

As shown in FIG. 1, the scroll compressor 1 includes a sealed container 10, a suction pipe 12 mounted penetratingly a top face of the sealed container 10 and formed as a hollow cylindrical pipe, a discharge pipe 14 discharging the gas refrigerant to the outside, a scroll compression mechanism 20 configured to compress a low-pressure gas refrigerant in a compression chamber 28, and a motor element 30 configured to drive the compression mechanism 20 which are housed in the sealed container 10.

The upper portion of the compression mechanism 20 is supported by a middle shell 10*a* of the sealed container 10. The compression mechanism 20 is fixed to the middle shell 10*a* of the sealed container 10 through shrink fit or other method. A sub-frame 16 is provided below the motor element 30. The sub-frame 16 is fixed to the inner circumferential surface of the sealed container 10. An oil sump 18 is formed on a bottom of the sealed container 10. A refrigerating machine oil lubricating sliding parts such as bearings is accumulated in the oil sump 18.

The suction pipe 12 configured to suck a low-pressure gas refrigerant into the compression mechanism 20 from outside is connected to a side surface of the sealed container 10. The discharge pipe 14 configured to discharge a high-pressure gas refrigerant to the outside of the scroll compressor 1 is connected to the side face of the sealed container 10.

The compression mechanism 20 is accommodated in the sealed container 10 and configured to compress the refrigerant sucked from the suction pipe 12 through rotation of a crankshaft 36 that is rotated by the motor element 30. As shown in FIG. 1, the compression mechanism 20 includes a fixed scroll 22 and an orbiting scroll 26.

The fixed scroll 22 is fixed to the middle shell 10*a* at a lower end portion of the fixed scroll 22. As shown in FIG. 1, the fixed scroll 22 includes a fixed scroll base plate 22*a* and a fixed scroll spiral wrap 22*b* having an involute curve shape so as to form a spiral body and erected on one surface of the fixed scroll base plate 22*a*. A discharge port 24 configured to discharge a compressed refrigerant is formed in a central part of the fixed scroll 22.

The orbiting scroll 26 is configured to orbit opposed to the fixed scroll 22 without rotating, by a non-illustrated Oldham mechanism. As shown in FIG. 1, the orbiting scroll 26 includes an orbiting scroll base plate 26*a* and an orbiting scroll spiral wrap 26*b* having an involute curve shape so as to form a spiral body and erected on one surface of the orbiting scroll base plate 26*a*. An orbiting bearing 26*c* formed in a bottomed cylindrical shape is formed in a substantially central part on an undersurface of the orbiting scroll base plate 26*a*. An eccentric shaft portion 36*b* installed on an upper end of a main shaft portion 36*a* described later is inserted in the orbiting bearing 26*c*, in order to cause the orbiting scroll 26 to orbit.

The orbiting scroll spiral wrap 26*b* is configured to be engaged with the fixed scroll spiral wrap 22*b* to form the compression chamber 28 between the fixed scroll spiral wrap 22*b* and the orbiting scroll spiral wrap 26*b*. The orbiting scroll 26 is configured to orbit opposed to the fixed scroll 22.

Figure 2A:
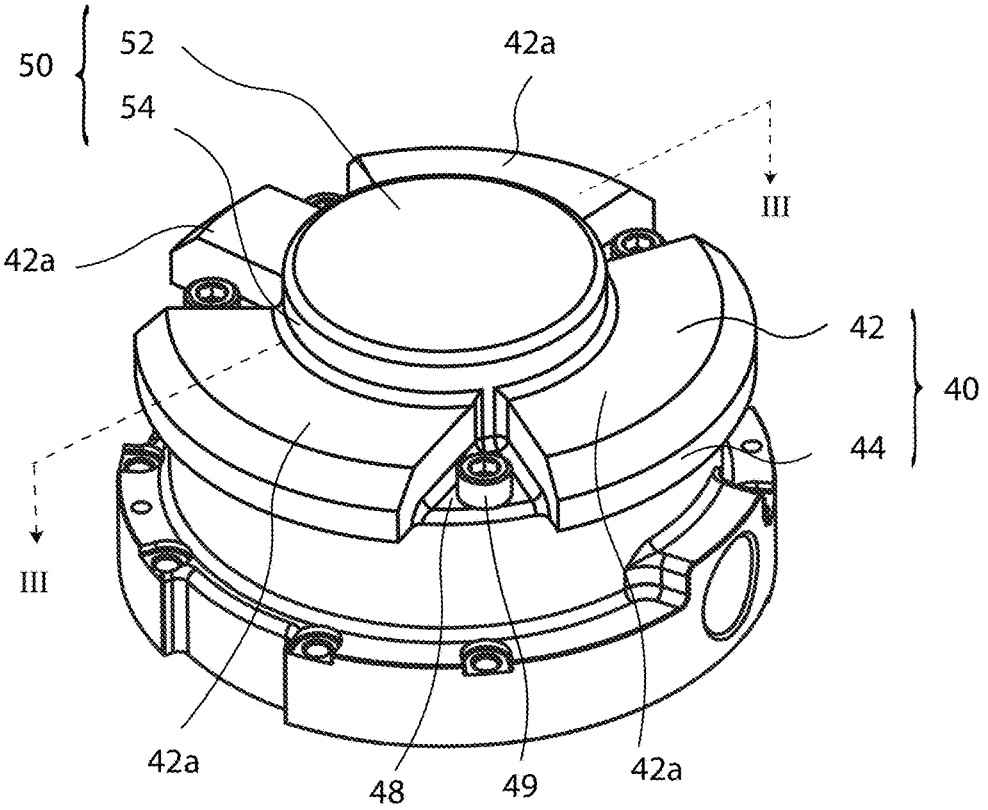
FIG. 2A is a perspective view of the first cover 40 fixed on a fixed scroll 22 and the second cover 50 fixed on the first cover 40 in FIG. 1 when viewed from obliquely above.
Figure 3:
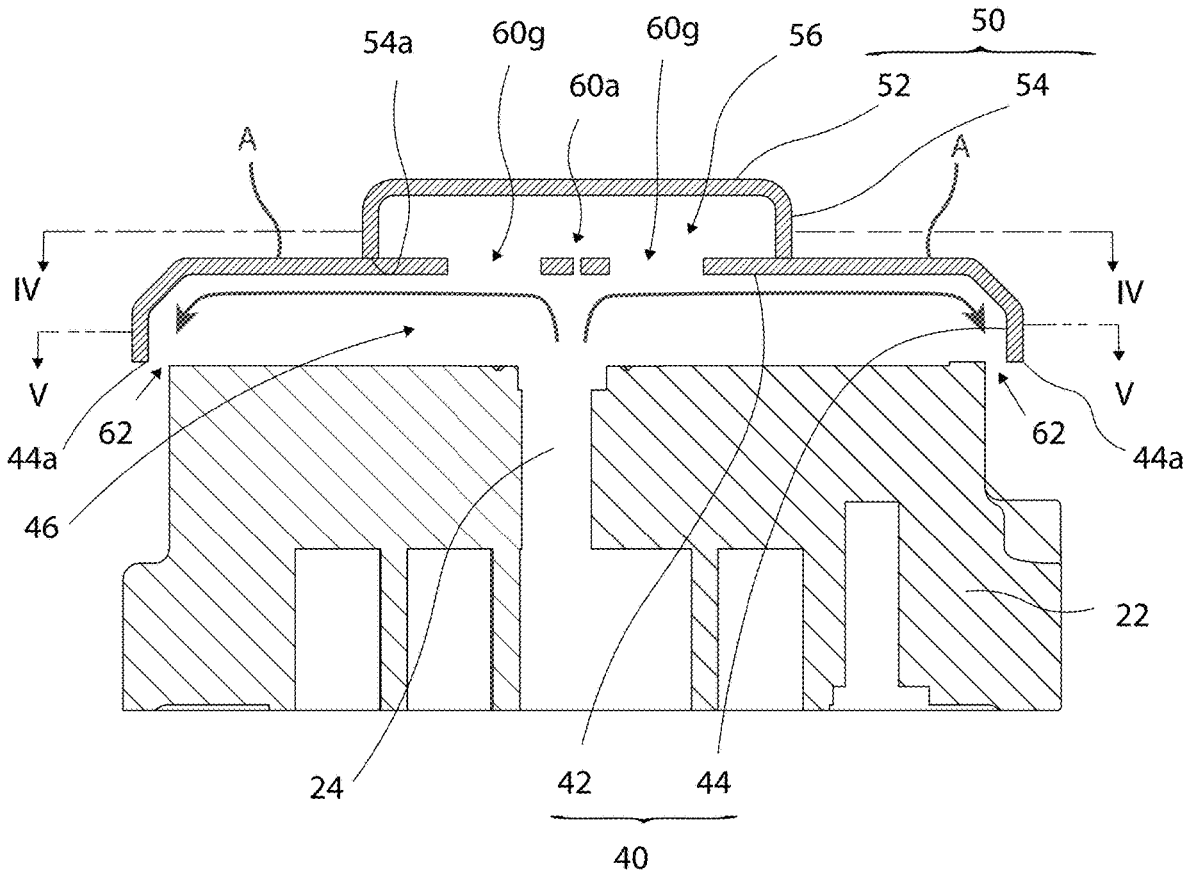
FIG. 3 is a cross sectional view taken along line III-III of FIG. 2A.

As shown in FIG. 1, FIG. 2A and FIG. 3, a first cover 40 with a second cover 50 is fixed on the top portion of the fixed scroll 22 by bolts 49.

The first cover 40 includes a first top plate 42, a first peripheral wall 44 extending downward from the entire circumference of an edge of the first top plate 42, and bottom portions 48 for fixing the first cover 40 to the fixed scroll 22. The first cover 40 is formed in a cap shape so as to be in a circular shape when viewed from above.

The first cover 40 is configured to form a first space 46 inside. Namely, the first space 46 is a space surrounded by the first top plate 42, the first peripheral wall 44, and the top portion of the fixed scroll 22. The first space 46 connects to the discharge port 24 that penetrates the fixed scroll 22 and allows compressed refrigerant to flow.

Figure 2B:
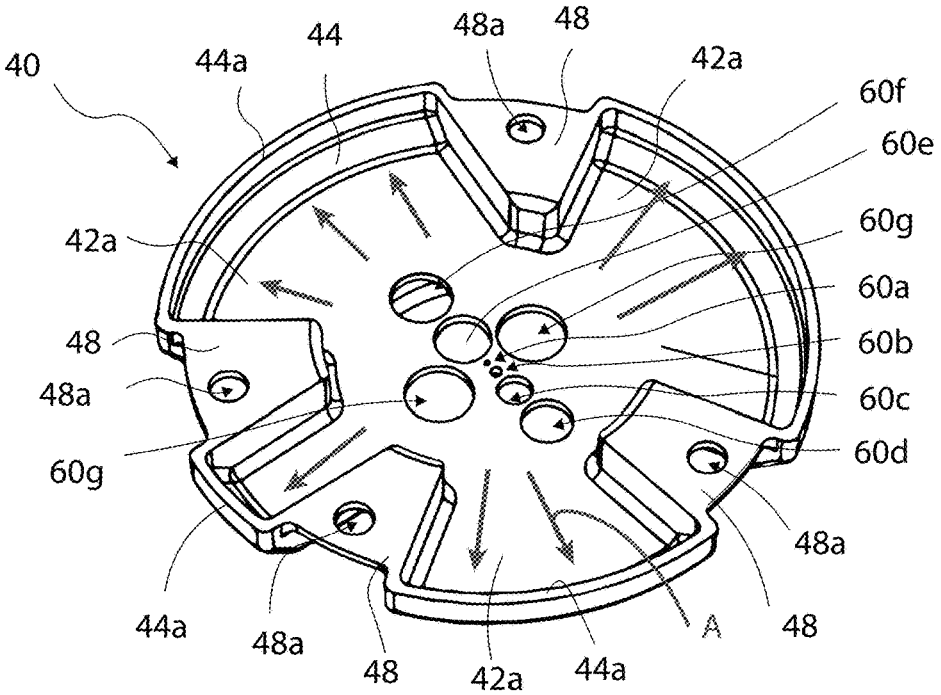
FIG. 2B is a perspective view of the first cover 40 and the second cover 50 in FIG. 1 when viewed from obliquely below.

As shown in FIG. 2A, FIG. 2B and FIG. 3, the first top plate 42 of the first cover 40 includes multiple extension portions 42*a* that extends outward beyond the top portion of the fixed scroll 22 when the first cover 40 viewed from above, so as to form gaps 62 between parts of a lower end 44*a* of the first peripheral wall 44 and the top portion of the fixed scroll 22. Each extension portion 42*a* is formed to widen in an outward direction.

When viewed from above, the bottom portion 48 with an opening 48*a* through which the bolt 49 penetrates is provided between the two extension portions 42*a* in order to fix the first cover 40 on the fixed scroll 22 by bolts 49.

Figure 5:
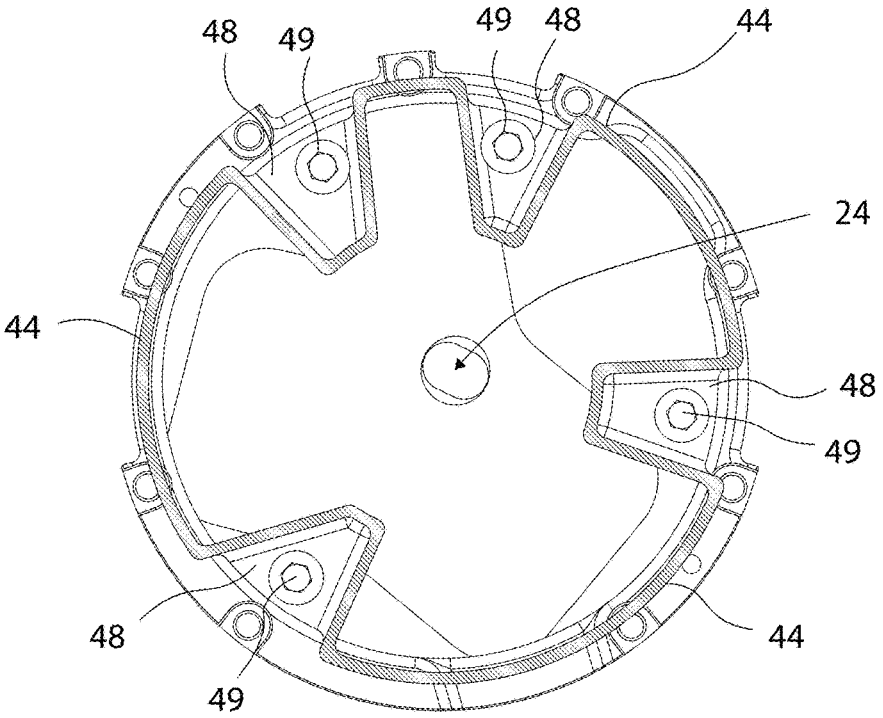
FIG. 5 is a cross sectional view taken along line V-V of FIG. 3.

As shown in FIG. 2B, FIG. 3 and FIG. 5, the first space 46 includes a plurality of chambers, each of which is surrounded by the extension portion 42*a* of the first top plate 42, the first peripheral wall 44 extending downward from the extension portion 42*a*, two bottom portions 48 and the top portion of the fixed scroll 22.

Figure 4:
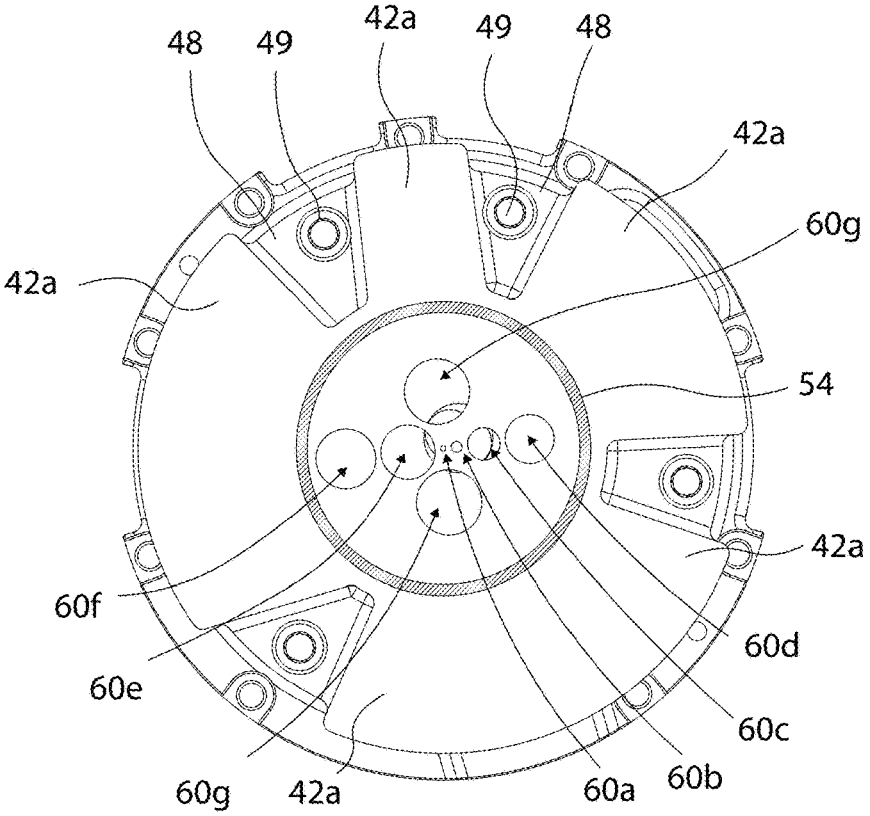
FIG. 4 is a cross sectional view taken along line IV-IV of FIG. 3.

The second cover 50 fixed on the first cover 40 includes a second top plate 52 and a second peripheral wall 54 extending downward from the entire circumference of an edge of the second top plate 52 so that an entire lower end 54*a* of the second peripheral wall 54 connects to the first top plate 42. The second cover 50 is configured to form a second space 56 inside. As shown in FIG. 2A and FIG. 4, the second cover 50 is formed in a circle shape when viewed from above and in a bowl shape.

As shown in FIG. 3 and FIG. 4, the second space 56 is formed as a chamber which is surrounded by the second top plate 52, the second peripheral wall 54 extending downward from the second top plate 52, and the first cover 40.

As shown in FIG. 2B, FIG. 3 FIG. 4, in the first top plate 42 of the first cover 40, multiple through holes 60*a*, 60*b*, 60*c*, 60*d*, 60*c*, 60*f*, 60*g* are formed to penetrate the first top plate 42 of the first cover 40 so that the through holes 60*a*. 60*b*, 60*c*. 60*d*, 60*c*, 60*f*. 60*g* with different diameters connect the first space 46 and the second space 56.

The diameters of the through holes 60*a*, 60*b*, 60*c*, 60*d*, 60*e*, 60*f*, 60*g* are formed so as to increase in the order of through holes 60*a*, 60*b*, 60*c*, 60*d*, 60*d*, 60*c*, 60*f*, and 60*g*. In addition, some of the multiple through holes 60*a*, 60*b*, 60*c*, 60*d*, 60*d*, 60*c*, 60*f*, and 60*g* may be formed to be the same diameter.

In the embodiment, the through hole 60*a*, 60*b*, 60*c*, 60*d*, 60*e*, 60*f*, 60*g* are formed in the central portion of the first cover 40. In addition, for the purpose of reducing influence of the compressed refrigerant that is discharged from the discharge port 24, the multiple through holes 60*a*, 60*b*, 60*c*, 60*d*, 60*d*, 60*c*, 60*f*, and 60*g* may be provided along peripheral edge portions of the first top plate 42 of the first cover 40.

In the embodiment, the through hole 60*a* of the first cover 40 formed in the direction in which the compressed refrigerant is discharged from the discharge port 24 to the first space 46, is formed so that the diameter of the through hole 60*a* is smaller than the diameters of the other through holes 60*b*, 60*c*, 60*d*, 60*e*, 60*f*, 60*g*. This can prevent turbulence of the compressed refrigerant that is discharged from the discharge port 24 and thereby reduce noise and vibration.

The motor element 30 includes an electric motor stator 32 fixed to the inner circumferential surface of the sealed container 10 through shrink fit or other method, an electric motor rotor 34 rotatably housed on an inner circumferential side of the electric motor stator 32, and the crankshaft 36

(main shaft portion 36*a*) fixed to the electric motor rotor 34 through shrink fit or other method. The electric motor rotor 34 is configured to rotate as electric power is supplied to the electric motor stator 32 and transmit a driving force to the orbiting scroll 26 through the crankshaft 36.

The eccentric shaft portion 36*b* located above the electric motor rotor 34 in the crankshaft 36 is rotatably supported in a radial direction by the cylindrical orbiting bearing 26*c* installed under the orbiting scroll base plate 26*a*. The main shaft portion 36*a* is fitted in a main bearing 39 and slides along the main bearing 39 by an oil film of a lubricating oil. The eccentric shaft portion 36*b* eccentric to the main shaft portion 36*a* is installed on the upper end of the crankshaft 36.

A pump element 19 such as a positive displacement pump is installed at a lower end of the crankshaft 36. The pump element 19 supplies the refrigerating machine oil accumulated in the oil sump 18 to the sliding parts such as the main bearing 39. The pump element 19 is mounted on the sub-frame 16 and supports the crankshaft 36 in the axial direction on an upper end surface of the pump element 19.

Next, an operation of the first cover 40 and the second cover 50 is described in details with reference to FIG. 1 to FIG. 5. Arrows "A" in FIG. 3 and FIG. 5 indicate flows of the compressed refrigerant.

Firstly, while the compressor 1 is in operation, the compressed refrigerant is discharged from the discharge port 24 to the first space 46. The compressed refrigerant discharged from the discharge port 24 to the first space 46 flows in the first space 46 in the direction in which the compressed refrigerant is discharged from the discharge port 24 to the first space 46.

In the embodiment, since the through hole 60*a* of the first cover 40 formed in the direction in which the compressed refrigerant is discharged from the discharge port 24 to the first space 46, is formed so that the diameter of the through hole 60*a* is smaller than the diameters of the other through holes 60*b*, 60*c*, 60*d*, 60*e*, 60*f*, 60*g*, it is possible to prevent turbulence of the compressed refrigerant that is discharged from the discharge port 24 and to reduce noise and vibration.

Moreover, since the configuration surrounded by the first cover 40 and the second cover 50 includes the second space 56 that communicates only with the first space 46 and multiple through holes 60*a*, 60*b*, 60*c*, 60*d*, 60*e*, 60*f*, 60*g* that communicate between the first space 46 and the second space 56, the configuration surrounded by the first cover 40 and the second cover 50 forms a Helmholtz type resonance chamber communicating with the first space 46. As such, it is possible to reduce noise and vibration caused by discharge pulsation and the mechanical moving parts.

Furthermore, since multiple through holes 60*a*, 60*b*, 60*c*, 60*d*, 60*e*, 60*f*, 60*g* are formed to penetrate the first top plate 42 of the first cover 40 so that the through holes 60*a*, 60*b*, 60*c*, 60*d*, 60*c*, 60*f*, 60*g* with different diameters connect the first space 46 and the second space 56, the Helmholtz type resonance chamber that resonates at different specific frequencies with a simple configuration can be formed.

Secondly, the compressed refrigerant that reaches the first top plate 42, the compressed refrigerant flows toward the first peripheral wall 44 by changing the flow direction of the compressed refrigerant.

The first space 46 includes the plurality of chambers, each of which is surrounded by the extension portion 42*a* of the first top plate 42, the first peripheral wall 44 extending downward from the extension portion 42*a*, two bottom portions 48 and the top portion of the fixed scroll 22. As such, the plurality of chambers in the first space 46 function as refrigerant flow paths from the center portion of the first space 46 to the peripheral edge portion of the first space 46.

Moreover, each of the multiple extension portion 42*a* is formed to extend outward beyond the top portion of the fixed scroll 22 when the first cover 40 viewed from above, so as to form gaps 62 between parts of the lower end 44*a* of the first peripheral wall 44 and the top portion of the fixed scroll 22. As such, the compressed refrigerant that flows inside the refrigerant flow path that is surrounded by the extension portion 42*a* of the first top plate 42, the first peripheral wall 44, two bottom portions 48, can is discharged out of the first space 46.

As a result, since the first top plate 42 includes the multiple extension portion 42*a* and the first space 46 includes the multiple chambers, it is possible that the compressed refrigerant is smoothly discharged out of the first space 46 while preventing the occurrence of turbulence. Therefore, according to the embodiment, the scroll compressor 1 can effectively reduce noise and vibration caused by discharge pulsation and mechanical moving parts with a simple configuration.

Although specific embodiments of the invention have been disclosed and described as well as illustrated in the companying drawings, it is simply for the purpose of better understanding of the principle of the present invention and it is not as a limitation of the scope and spirit of the teaching of the present invention. Adaption and modification to various structures such as design or material of the invention, mounting mechanism of various parts and elements or embodiments are possible and apparent to a skilled person without departing from the scope of the present invention which is to be determined by the claims.

LIST OF REFERENCE

1: scroll compressor
10: sealed container
10*a*: middle shell
12: suction pipe
14: discharge pipe
16: sub-frame
18: oil sump
19: pump element
20: compression mechanism
22: fixed scroll
22*a*: fixed scroll base plate
22*b*: fixed scroll spiral wrap
24: discharge port
26: orbiting scroll
26*a*: orbiting scroll base plate
26*b*: orbiting scroll spiral wrap
26*c*: orbiting bearing
28: compression chamber
30: motor element
32: electric motor stator
34: electric motor rotor
36: crankshaft
36*a*: main shaft portion
36*b*: eccentric shaft portion
39: main bearing
40: first cover
42: first top plate
42*a*: extension portion
44: first peripheral wall
44*a*: lower end of the first peripheral wall
46: first space
48: bottom portion

48*a*: opening
49: bolt
50: second cover
52: second top plate
54: second peripheral wall
54*a*: lower end of the second peripheral wall
56: second space
60, 60*a*. 60*b*. 60*c*. 60*d*. 603*c*. 60*f*. 60*g*: through hole
62: gap
A: flow of the compressed refrigerant

The invention claimed is:

1. A scroll compressor comprising:

a first cover fixed on a fixed scroll; and a second cover fixed on the first cover, wherein the first cover includes a first top plate and a first peripheral wall extending downward from the entire circumference of an edge of the first top plate, which is configured to form a first space inside, wherein the first top plate of the first cover includes multiple extension portions that extend outward beyond a top portion of the fixed scroll when the first cover is viewed from above, so as to form gaps between parts of a lower end of the first peripheral wall and the top portion of the fixed scroll, wherein the second cover includes a second top plate and a second peripheral wall extending downward from the entire circumference of an edge of the second top plate so that an entire lower end of the second peripheral wall connects to the first top plate, which is configured to form a second space inside, wherein the first space connects to a discharge port that penetrates the fixed scroll and allows compressed refrigerant to flow, and wherein multiple through holes are formed to penetrate the first top plate of the first cover so that the through holes with different diameters connect the first space and the second space.

2. A scroll compressor comprising:

a first cover fixed on a fixed scroll; and a second cover fixed on the first cover, wherein the first cover includes a first top plate and a first peripheral wall extending downward from the entire circumference of an edge of the first top plate, which is configured to form a first space inside, wherein the second cover includes a second top plate and a second peripheral wall extending downward from the entire circumference of an edge of the second top plate so that an entire lower end of the second peripheral wall connects to the first top plate, which is configured to form a second space inside, wherein the first space connects to a discharge port that penetrates the fixed scroll and allows compressed refrigerant to flow, wherein multiple through holes are formed to penetrate the first top plate of the first cover so that the through holes with different diameters connect the first space and the second space, and wherein one of the through holes of the first cover is formed in the direction in which so as to allow the compressed refrigerant is discharged from the discharge port to the second space, is formed so that the diameter of the one of the through holes is smaller than the diameter of the other through holes.

* * * * *